US009878535B2

(12) United States Patent
Kaneko et al.

(10) Patent No.: US 9,878,535 B2
(45) Date of Patent: Jan. 30, 2018

(54) INK CIRCULATION DEVICE AND PRINTER

(71) Applicant: TOSHIBA TEC KABUSHIKI KAISHA, Shinagawa-ku, Tokyo (JP)

(72) Inventors: Yoshiaki Kaneko, Shizuoka (JP); Shinichiro Hida, Shizuoka (JP); Tetsuya Sato, Kanagawa (JP); Kazuhiro Hara, Shizuoka (JP); Kazuhiko Ohtsu, Shizuoka (JP); Hiroyuki Ishikawa, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/244,239

(22) Filed: Aug. 23, 2016

(65) Prior Publication Data

US 2017/0217164 A1 Aug. 3, 2017

(30) Foreign Application Priority Data

Jan. 28, 2016 (JP) ..... 2016-014819

(51) Int. Cl.

| | |
|---|---|
| ***B41J 2/045*** | (2006.01) |
| ***B41J 2/14*** | (2006.01) |
| ***B41J 2/175*** | (2006.01) |
| ***B41J 2/18*** | (2006.01) |
| ***B41J 2/195*** | (2006.01) |

(52) U.S. Cl.

CPC ..... *B41J 2/04563* (2013.01); *B41J 2/04581* (2013.01); *B41J 2/14233* (2013.01); *B41J 2/175* (2013.01); *B41J 2/17596* (2013.01); *B41J 2/18* (2013.01); *B41J 2/195* (2013.01); *B41J 2202/12* (2013.01)

(58) Field of Classification Search

CPC . B41J 2/04563; B41J 2/04581; B41J 2/14233
See application file for complete search history.

(56) References Cited

U.S. PATENT DOCUMENTS

| | | | | |
|---|---|---|---|---|
| 9,205,665 | B2 | 12/2015 | Kaneko | |
| 2008/0030554 | A1 | 2/2008 | Sugahara | |
| 2015/0174910 | A1 * | 6/2015 | Kaneko | B41J 2/17596 347/85 |

FOREIGN PATENT DOCUMENTS

| | | |
|---|---|---|
| EP | 2995458 | 3/2016 |

OTHER PUBLICATIONS

Extended European Search Report for European Patent Application No. 16189293.0 dated Jun. 9, 2017.

* cited by examiner

*Primary Examiner* — Alessandro Amari
*Assistant Examiner* — Roger W Pisha, II
(74) *Attorney, Agent, or Firm* — Amin, Turocy & Watson LLP

(57) ABSTRACT

In accordance with an embodiment, an ink circulation device comprises a pressure chamber including at least two flow holes through which ink flows; a piezoelectric vibration plate constituting a part of a wall of the pressure chamber and to be driven to increase or decrease an inner volume of the pressure chamber; a valve for opening and closing at least one of the two flow holes; a heater affixed on the piezoelectric vibration plate; and a connection section connecting the pressure chamber to an inkjet head.

11 Claims, 5 Drawing Sheets

INK CIRCULATION DEVICE AND PRINTER

CROSS-REFERENCE TO RELATED APPLICATION

This application is based upon and claims the benefit of priority from Japanese Patent Application No. P2016-014819, filed Jan. 28, 2016, the entire contents of which are incorporated herein by reference.

FIELD

Embodiments described herein relate generally to an ink circulation device and a printer.

BACKGROUND

There is known an ink circulation device for a circulation-type inkjet head corresponding to various kinds of ink, such as solvent ink, oil-based ink or water-based ink. In order to eject a proper liquid drop amount of the ink from the inkjet head, in some cases, the ink is heated to adjust the viscosity thereof.

The shape forming the appearance of the ink circulation device is constituted by a casing. If the ink inside the ink circulation device is heated with a heater mounted on the outer surface of the casing, as the casing is relatively thick, it is difficult to transmit heat generated by the heater to the ink, and there is a problem that the ink cannot be heated to a desired temperature.

DETAILED DESCRIPTION

In accordance with an embodiment, an ink circulation device comprises a pressure chamber, a piezoelectric vibration plate, a valve, a heater and a connection section. The pressure chamber includes at least two flow holes through which ink flows. The piezoelectric vibration plate constitutes a part of a wall of the pressure chamber and is driven to increase or decrease an inner volume of the pressure chamber. The valve opens and closes at least one of the two flow holes. The heater is laminated on the piezoelectric vibration plate. The connection section connects the pressure chamber to an inkjet head.

In accordance with another embodiment, an ink circulation method within a printer involves driving a piezoelectric vibration plate constituting a part of a wall of a pressure chamber to increase or decrease an inner volume of the pressure chamber and thereby circulating ink therein; opening and closing at least one of two flow holes in the pressure chamber; and heating the piezoelectric vibration plate.

Hereinafter, an embodiment relating to the ink circulation device and a printer is described with reference to the accompany drawings.

Figure 1:
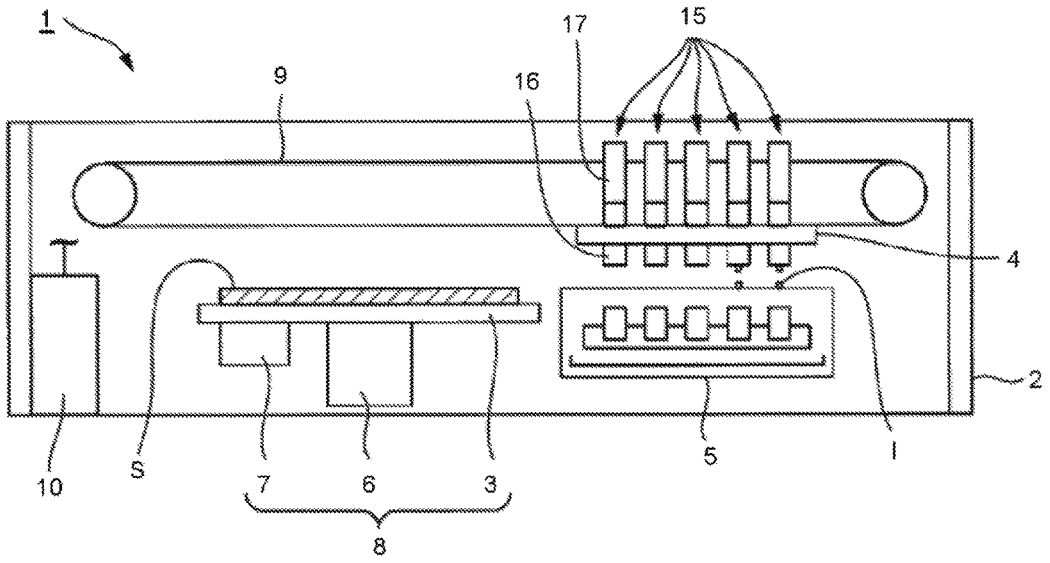
FIG. 1 is a front view schematically illustrating a printer according to an embodiment.

As shown in FIG. 1, a printer 1 according to the present embodiment is equipped with a feeding table 3, a carriage 4, and a maintenance unit 5 inside a housing 2.

The feeding table 3 is slidably held by a guide rail for feeding 6 arranged inside the housing 2. The guide rail for feeding 6 linearly extends in a substantially horizontal direction. The feeding table 3 is moved in a direction along the guide rail for feeding 6 by a motor (not shown). A negative pressure generation device 7 for absorbing a sheet-like image receiving medium S such as a sheet to fix the image receiving medium S on the feeding table 3 is arranged in the feeding table 3. The feeding table 3, the guide rail for feeding 6, the motor and the negative pressure generation device 7 constitute a conveyance section 8 for conveying the image receiving medium S to an inkjet head 16 described later.

Further, the image receiving medium S is not limited to a paper, and it may be a film made of resin or metal or a plate made of wood.

The carriage 4 is sidably held by a guide rail for scanning (not shown) arranged inside the housing 2. The guide rail for scanning linearly extends in a substantially horizontal direction orthogonal to the guide rail for feeding 6. The carriage 4 is moved in a direction along the guide rail for scanning through a conveyance belt 9 driven by a motor (not shown). A plurality of inkjet units 15 arranged along a scanning direction of the carriage 4 is loaded in the carriage 4.

Figure 2:
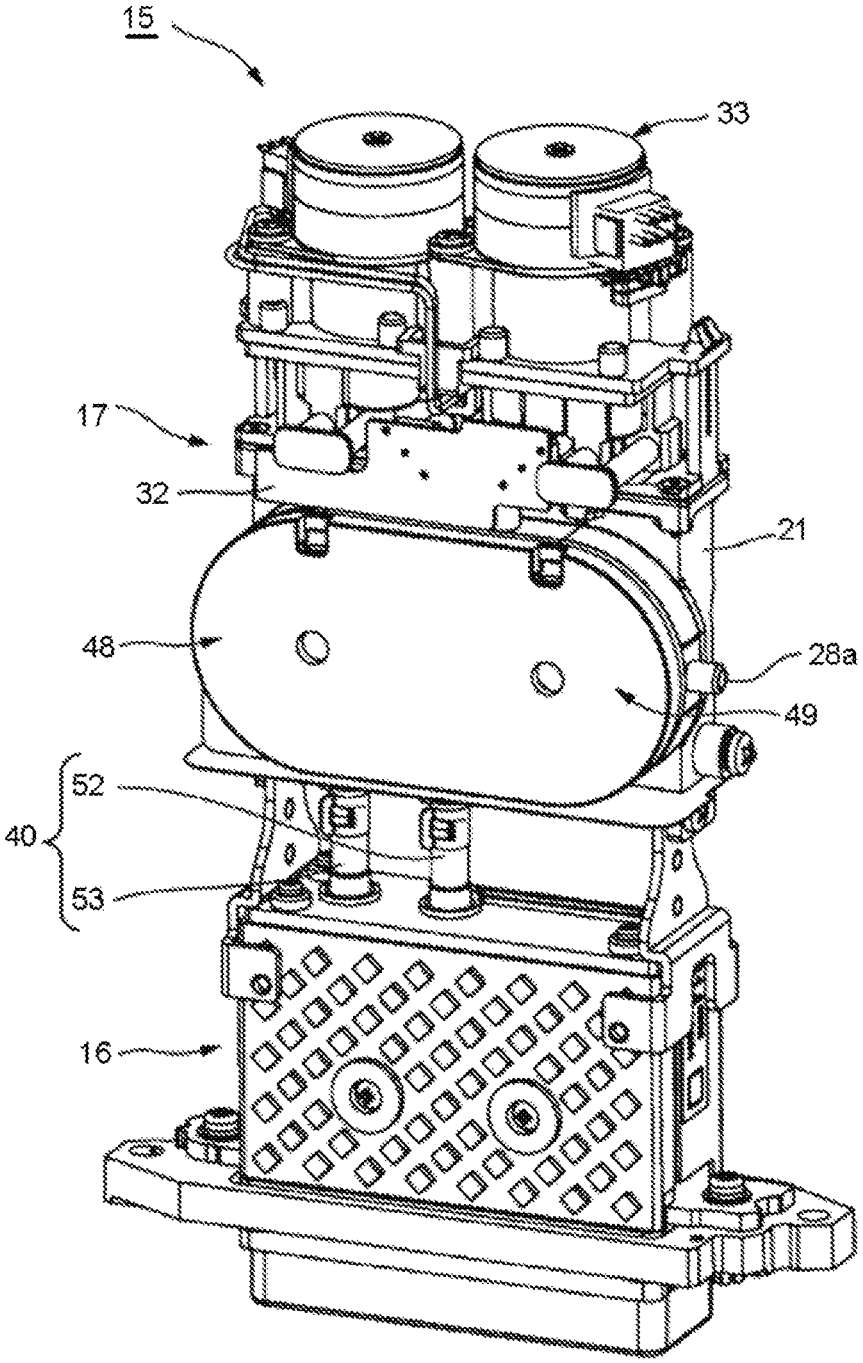
FIG. 2 is a perspective view of an inkjet unit of the printer according to the embodiment.
Figure 3:
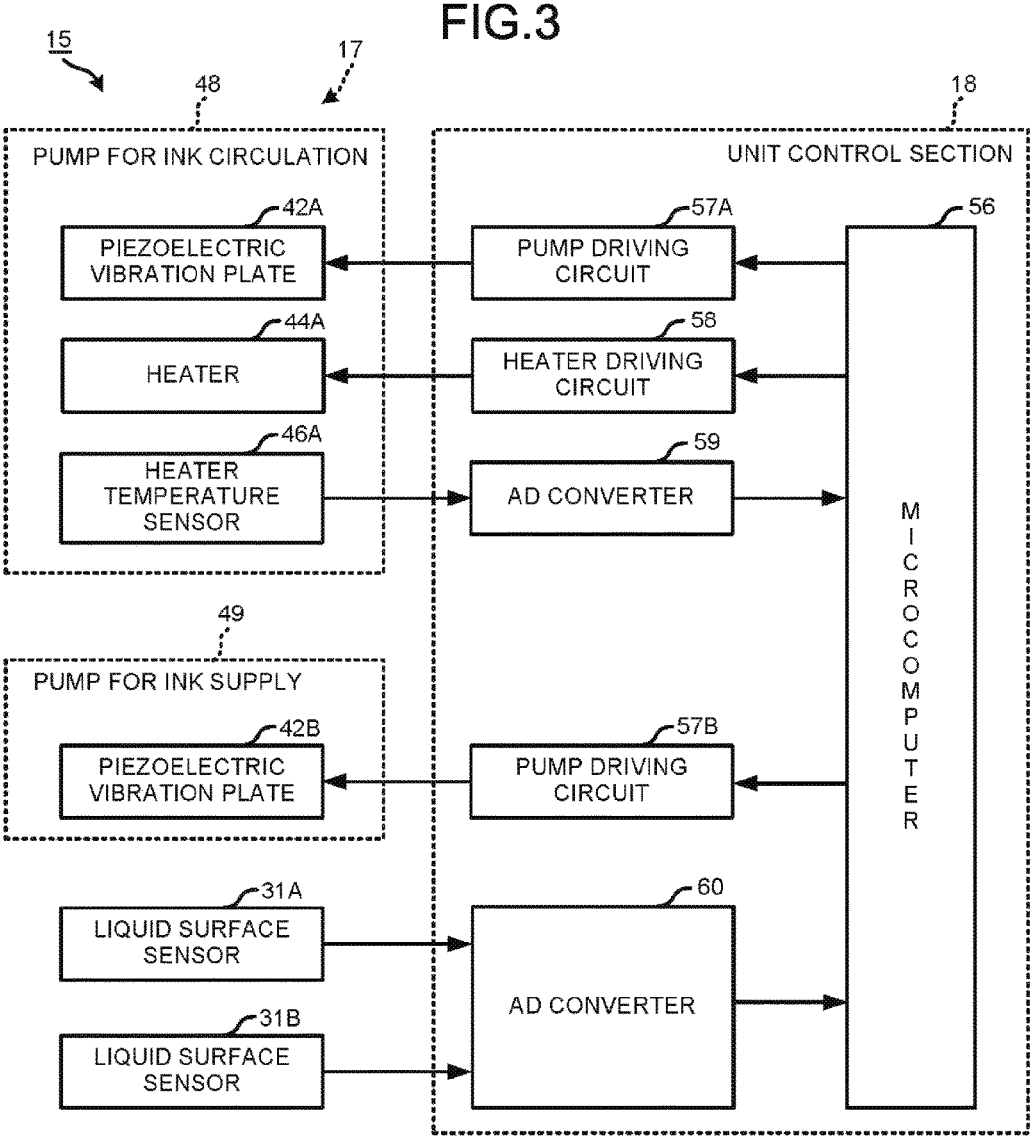
FIG. 3 is a block diagram of the inkjet unit according to the embodiment.

As shown in FIG. 1 to FIG. 3, the inkjet unit 15 is equipped with an inkjet head 16 for injecting the ink I onto the image receiving medium S, an ink circulation device 17 of the present embodiment connected with the inkjet head 16 at the upper side of the inkjet head 16 and a unit control section (control section) 18 for controlling the inkjet head 16 and the ink circulation device 17.

The inkjet unit 15 the number of which corresponds to the category of the ink I injected onto the image receiving medium S is loaded in the carriage 4. The ink I injected from each inkjet unit 15 may include transparent glossiness ink or special ink which develops color when irradiated with an infrared ray or an ultraviolet ray in addition to the ink having various colors such as cyan, magenta, yellow, black, white and the like.

An ink cartridge (not shown) is connected with the ink circulation device 17 of each inkjet unit 15. These ink cartridges are arranged inside the housing 2. The ink circulation device 17 of each inkjet unit 15 and the ink cartridge are connected with each other through a flexible connection tube (not shown). A plurality of the inkjet units 15 is aggregately arranged above the carriage 4 and moves along the guide rail for scanning together with the carriage 4.

The maintenance unit 5 covers the injection section of the inkjet head 16 for injecting the ink I to prevent evaporation of the ink I at the time a plurality of the inkjet units 15 and the carriage 4 return to a standby position at which the ink I is not injected from the inkjet head 16. The maintenance unit 5 appropriately cleans the contact portion of the inkjet head 16 with the image receiving medium S at the time a plurality of the inkjet units 15 returns to the standby position.

A main control section 10 is connected with the motor, the negative pressure generation device 7, the maintenance unit 5 and each inkjet unit 15 to control them.

The inkjet head 16 of each inkjet unit 15 is equipped with a plurality of nozzle sections (not shown) for injecting the ink I onto the image receiving medium S and actuators (not shown) arranged to face each nozzle section. The actuator is composed of, for example, a piezoelectric vibration plate using piezoelectric ceramic. If a signal is input to the actuator, the actuator increases the pressure of the ink I so that the ink I is injected from each nozzle section. With the injected ink I, the image receiving medium S is printed.

Figure 4:
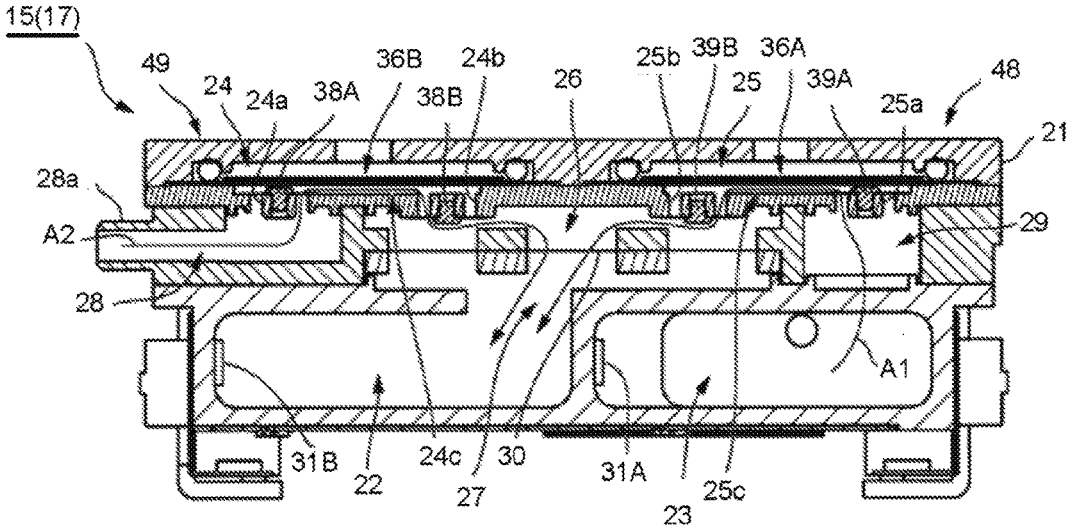
FIG. 4 is a cross-sectional view of an ink circulation device according to the embodiment.

As shown in FIG. 2 and FIG. 4, the ink circulation device 17 of each inkjet unit 15 is equipped with a casing 21, an actuator unit for circulation 36A and an actuator unit for supply 36B which are mounted in the casing 21, valve bodies 38A, 38B, 39A and 39B and a connection section 40. The casing 21 is formed by, for example, carrying out die casting on aluminum. In the casing 21, an ink supply chamber 22, an ink collection chamber 23, a supply pump housing chamber 24, a circulation pump housing chamber 25, an ink chamber 26, a communicating path 27, a replenishing path 28, and an inflow port 29 serving as internal spaces are formed.

As shown in FIG. 3 and FIG. 4, a well-known liquid surface sensor 31B for detecting a liquid surface of the ink I in the ink supply chamber 22 is mounted in the ink supply chamber 22. A well-known liquid surface sensor 31A for detecting a liquid surface of the ink I in the ink collection chamber 23 is mounted in the ink collection chamber 23. The liquid surface sensors 31A and 31B are connected with the unit control section 18 to send detection results of the liquid surface of the ink I to the unit control section 18. Though not shown, the upper part of the liquid surface of the ink I in the ink supply chamber 22 and the upper part of the liquid surface of the ink I in the ink collection chamber 23 respectively form air chambers. A pressure sensor 32 and a pressure adjustment section 33 shown in FIG. 2 are mounted in the casing 21. The pressure sensor 32 communicates with each forgoing air chamber to detect the pressure of the two ink chambers 22 and 23. The pressure adjustment section 33 adjusts the pressure of the inside of the casing 21 so as to properly keep surface pressure of each nozzle section of the inkjet head 16 based on the detection result of the pressure sensor 32.

As shown in FIG. 4, the ink supply chamber 22 communicates with the communicating path 27. An end of the replenishing path 28 forms a pipe line of a replenishing port 28*a* arranged at the outer surface of the casing 21 and opens to the outside of the casing 21. The replenishing port 28*a* is connected with the foregoing ink cartridge via a connection tube. The replenishing path 28 communicates with the supply pump housing chamber 24 via a flow hole 24*a* penetrating a wall which partitions the replenishing path 28 and the supply pump housing chamber 24. In the wall, the valve body 38A serving as a well-known check valve is mounted. The valve body 38A opens and closes the flow hole 24*a* to allow the flow of the ink I from the replenishing path 28 to the supply pump housing chamber 24 through the flow hole 24*a* and regulate the flow of the ink I from the supply pump housing chamber 24 to the replenishing path 28. The supply pump housing chamber 24 communicates with the ink chamber 26 via a flow hole 24*b* penetrating a wall which partitions the ink chamber 26 and the supply pump housing chamber 24. In the wall, the valve body 38B is mounted. The valve body 38B opens and closes the flow hole 24*b* to allow the flow of the ink I from the supply pump housing chamber 24 to the ink chamber 26 through the flow hole 24*b* and regulate the flow of the ink I from the ink chamber 26 to the supply pump housing chamber 24.

The ink chamber 26 communicates with the communicating path 27 via a filter 30. The ink collection chamber 23 communicates with the inflow port 29. The inflow port 29 communicates with the circulation pump housing chamber 25 via a flow hole 25*a* penetrating a wall which partitions the inflow port 29 and the circulation pump housing chamber 25. In the wall, the valve body 39A is mounted. The valve body 39A opens and closes the flow hole 25*a* to allow the flow of the ink I from the inflow port 29 to the circulation pump housing chamber 25 through the flow hole 25*a* and regulate the flow of the ink I from the circulation pump housing chamber 25 to the inflow port 29. The circulation pump housing chamber 25 communicates with the ink chamber 26 via a flow hole 25*b* penetrating a wall which partitions the ink chamber 26 and the circulation pump housing chamber 25. In the wall, the valve body 39B is mounted. The valve body 39B opens and closes the flow hole 25*b* to allow the flow of the ink I from the circulation pump housing chamber 25 to the ink chamber 26 through the flow hole 25*b* and regulate the flow of the ink I from the ink chamber 26 to the circulation pump housing chamber 25.

In the present embodiment, the components of the actuator unit for circulation 36A are the same as those of the actuator unit for supply 36B except that the actuator unit for supply 36B is not equipped with a heater 44A and a heater temperature sensor 46A described later. Thus, the component of the actuator unit for circulation 36A is indicated by adding a capital letter "A" to the number, and the component of the actuator unit for supply 36B corresponding to that of the actuator unit for circulation 36A is indicated by adding a capital letter "B" to the same number as the actuator unit for circulation 36A. In this way, the repeated description thereof is omitted. For example, a piezoelectric vibration plate 42A and a piezoelectric vibration plate 42B shown in FIG. 3 are the same components.

Figure 5:
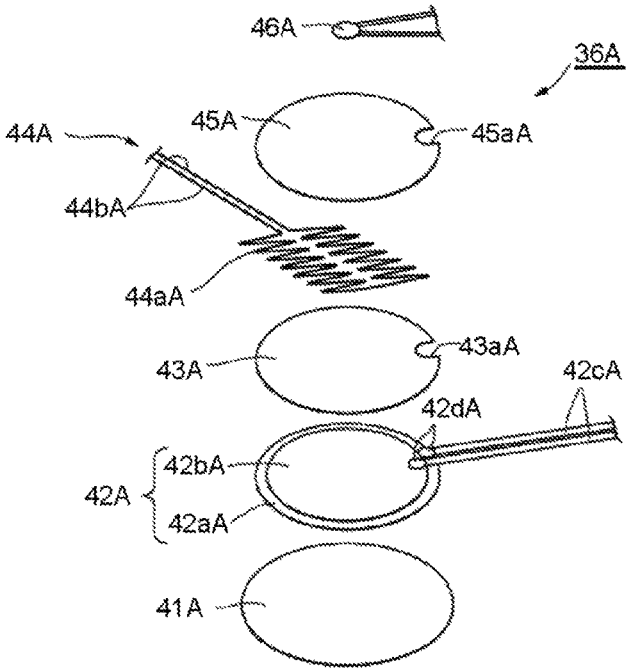
FIG. 5 is a perspective view illustrating a disassembled actuator unit for circulation of the ink circulation device according to the embodiment.

As shown in FIG. 5, the actuator unit for circulation 36A is formed into a laminated structure by laminating a liquid contact sheet 41A, the piezoelectric vibration plate 42A, an insulating sheet 43A, the heater 44A, an insulating sheet 45A and a heater temperature sensor (temperature sensor) 46A in order in a mutually attached manner.

The liquid contact sheet 41A is made of resin which contacts with the ink I in a pressure chamber for circulation 25*c* described later. PI (polyimide) which is difficult to generate chemical change due to the solvent of the ink is used as the material forming the liquid contact sheet 41A. In the embodiment, the liquid contact sheet 41A, the piezoelectric vibration plate 42A and the insulating sheets 43A and 45A are formed in a circular plate shape.

The piezoelectric vibration plate 42A is a unimorph type piezoelectric vibration plate composed of a metal plate 42*a*A and a piezoelectric ceramic 42*b*A. The material forming the metal plate 42*a*A is, for example, brass. The material forming the piezoelectric ceramic 42*b*A is, for example, PZT (lead zirconate titanate). The piezoelectric ceramic 42*b*A is subjected to Ni/Au-plated electrode on upper and lower surfaces thereof and has a piezoelectric property by a polarization processing. An end of a lead wire for vibration plate 42*c*A is respectively connected with the metal plate 42*a*A and the piezoelectric ceramic 42*b*A through a solder portion 42*d*A. The lead wire for vibration plate 42*c*A is a cable for applying AC voltage generated by a pump driving circuit 57A described later of the unit control section 18 to the piezoelectric vibration plate 42A.

The heater 44A is configured by respectively connecting a lead wire for heater 44*b*A with both ends of a heater main body 44*a*A which is formed into a bellows shape. The heater main body 44*a*A is a resistor, formed by a heating wire such as stainless steel, nichrome wire and the like, of which the value of the electrical resistance is several Ω (ohms) to several thousand Ω. In the embodiment, the heater main body 44*a*A is formed into a bellows shape; however, the shape of the heater main body 44*a*A is not particularly limited as long as it is a shape which can increase the length of the heater main body 44*a*A arranged in a certain area. The heater main body 44*a*A can be formed into a spiral shape or the like other than the bellows shape. The heater main body 44*a*A generates heat if a voltage from the unit control section 18 is applied. The generated heat is used to heat the ink I in the pressure chamber for circulation 25*c* described later via the insulating sheet 43A, the piezoelectric vibration plate 42A and the liquid contact sheet 41A.

It is preferable that the lead wire for heater 44*b*A of the heater 44A and the lead wire for vibration plate 42*c*A of the piezoelectric vibration plate 42A are arranged in different directions of the circumferential direction the piezoelectric vibration plate 42A. With such a configuration, it can be suppressed that the heater 44A contacts with the solder portion 42*d*A. In the present embodiment, the heater 44A is arranged between the insulating sheet 43A and the insulating sheet 45A.

The insulating sheets 43A and 45A are covers for covering the heater 44A by sandwiching the heater 44A therebetween. The insulating sheets 43A and 45A are formed by PI sheets. Notches 43*a*A and 45*a*A for avoiding the solder portion 42*d*A are arranged in the insulating sheets 43A and 45A. Through arranging the solder portion 42*d*A in the notches 43*a*A and 45*a*A, the thickness of the whole of the actuator unit for circulation 36A can be suppressed.

A thermistor can be suitably used in the heater temperature sensor 46A. The heater temperature sensor 46A is affixed or laminated on the piezoelectric vibration plate 42A across the insulating sheets 43A and 45A and the heater 44A. The heater temperature sensor 46A is connected to the unit control section 18 to transmit the detected temperature of the heater 44A to the unit control section 18. In order to mutually bond the liquid contact sheet 41A with the piezoelectric vibration plate 42A, an epoxy-based or silicone-based adhesive can be used or an adhesive tape can be used.

The actuator unit for circulation 36A with such a configuration is formed into a thin plate shape of which the thickness of the whole is 500-1000 μm (micrometers). Thus, the heat generated by the heater 44A can be transmitted to the ink I with a little loss. The thickness of the actuator unit for circulation 36A is sufficiently thinner than that of the wall of the casing 21.

As shown in FIG. 4, the actuator unit for circulation 36A is mounted in such a manner that the actuator unit for circulation 36A can be moved at both sides of the thickness direction of the actuator unit for circulation 36A in the circulation pump housing chamber 25. The space of the circulation pump housing chamber 25 at the flow holes 25*a* and 25*b* side with respect to the actuator unit for circulation 36A, the wall of the casing 21 surrounding the space and the actuator unit for circulation 36A constitute a pressure chamber for circulation (pressure chamber) 25*c*.

In other words, two flow holes 25*a* and 25*b* through which the ink I flows as described later are formed in the pressure chamber for circulation 25*c*. The piezoelectric vibration plate 42A of the actuator unit for circulation 36A constitutes a part of the wall of the pressure chamber for circulation 25*c*. A pump for ink circulation 48 for circulating the ink I in the ink circulation device 17 and the inkjet head 16 and including the pressure chamber for circulation 25*c* and the valve bodies 39A and 39B is constituted. The piezoelectric vibration plate 42A is driven to move the actuator unit for circulation 36A in the thickness direction thereof to increase or decrease the volume of the inside of the pressure chamber for circulation 25*c*.

Similarly, the actuator unit for supply 36B is mounted in such a manner that the actuator unit for supply 36B can be moved at both sides of the thickness direction of the actuator unit for supply 36B in the supply pump housing chamber 24. The space of the supply pump housing chamber 24 at the flow holes 24*a* and 24*b* side with respect to the actuator unit for supply 36B, the wall of the casing 21 surrounding the space and the actuator unit for supply 36B constitute a pressure chamber for supply 24*c*.

In other words, two flow holes 24*a* and 24*b* through which the ink I flows as described later are formed in the pressure chamber for supply 24*c*. The piezoelectric vibration plate 42B of the actuator unit for supply 36B constitutes a part of the wall of the pressure chamber for supply 24*c*. A pump for ink supply 49 for supplying the ink I to the ink circulation device 17 from the outside is constituted by the pressure chamber for supply 24*c* and the valve bodies 38A and 38B. The piezoelectric vibration plate 42B is driven to move the actuator unit for supply 36B in the thickness direction thereof to increase or decrease the volume of the inside of the pressure chamber for supply 24*c*.

Further, two flow holes 25*a* and 25*b* are formed in the pressure chamber for circulation 25*c*; however, the number of the flow holes formed in the pressure chamber for circulation 25*c* is not particularly limited, and may be three or more, which is the same as the pressure chamber for supply 24*c*.

The inkjet unit 15 may be not equipped with the valve bodies 38B and 39B. Even in such a configuration, the ink I can flow only in one direction.

As shown in FIG. 2, the connection section 40 includes an ink supply pipe 52 and an ink return pipe 53. One end of the ink supply pipe 52 communicates with the ink supply chamber 22 of the casing 21, and the other end of the ink supply pipe 52 communicates with each nozzle section of the inkjet head 16.

On the other hand, one end of the ink return pipe 53 communicates with each nozzle section of the inkjet head 16, and the other end of the ink return pipe 53 communicates with the ink collection chamber 23 of the casing 21. The ink return pipe 53 connects the pressure chamber for circulation 25*c* to the inkjet head 16 via the inflow port 29 and the ink collection chamber 23.

As shown in FIG. 3, the unit control section 18 is equipped with a microcomputer 56, the pump driving circuits 57A and 57B, a heater driving circuit 58 and AD converters 59 and 60. The unit control section 18 is mounted, for example, on the outer surface of the ink circulation device 17 through a screw.

A section for controlling the pressure sensor 32 and a section for controlling the actuator of the inkjet head 16 in the unit control section 18 are not recorded in FIG. 3, and the description thereof is omitted. The unit control section 18 is dedicated to the ink circulation device 17, and the control section for controlling the inkjet head 16 may be arranged separated from the unit control section 18.

The microcomputer 56 includes an arithmetic circuit and a memory (not shown). The memory stores a control program of the microcomputer 56 and Curie temperature of the piezoelectric vibration plate 42A. The Curie temperature of the piezoelectric vibration plate 42A is, for example, 200 degrees centigrade-300 degrees centigrade. The pump driving circuits 57A and 57B generate a predetermined alternating voltage. The pump driving circuit 57A is connected with the piezoelectric vibration plate 42A to control the piezoelectric vibration plate 42A. The pump driving circuit 57B is connected with the piezoelectric vibration plate 42B to control the piezoelectric vibration plate 42B.

The heater driving circuit 58 generates, for example, various voltage waveforms the sizes of which are different and applies the voltage to the heater 44A. The heater driving circuit 58 controls the heater 44A. The AD converter 59 converts a voltage signal to a digital waveform through an analog waveform sent from the heater temperature sensor 46A to send the digital waveform to the microcomputer 56. The AD converter 60 converts a voltage signal to a digital waveform through an analog waveform sent from the liquid surface sensors 31A and 31B to send the digital waveform to the microcomputer 56. The microcomputer 56 controls the heater driving circuit 58 based on the detection result of the temperature of the heater 44A sent from the AD converter 59 in such a manner that the temperature detected by the heater temperature sensor 46A is equal to or lower than the half of the Curie temperature of the piezoelectric vibration plate 42A. Through such a control operation, piezoelectric property of the piezoelectric vibration plate 42A cannot be lost.

In the present embodiment, the temperature detected by the heater temperature sensor 46A is controlled to be equal to or lower than the half of the Curie temperature of the piezoelectric vibration plate 42A; however, the temperature detected by the heater temperature sensor 46A may be controlled to be lower than the Curie temperature of the piezoelectric vibration plate 42A.

Next, the function of the inkjet unit 15 of the printer 1 with the foregoing configuration is described.

The microcomputer 56 steadily drives the piezoelectric vibration plate 42A of the pump for ink circulation 48 with the pump driving circuit 57A, and regularly reads the detection result of the temperature which is converted by the AD converter 59 and detected by the heater temperature sensor 46A. Then, the microcomputer 56 controls the heater driving circuit 58 to apply the voltage to the heater 44A in such a manner that the temperature of the heater 44A detected by the heater temperature sensor 46A is equal to or lower than the half of the Curie temperature of the piezoelectric vibration plate 42A.

In a case in which the Curie temperature of the piezoelectric vibration plate 42A is 200 degrees centigrade-300 degrees centigrade, the temperature of the heater 44A detected by the heater temperature sensor 46A is controlled to be equal to or lower than the half of the Curie temperature, in other words, equal to or lower than 100 degrees centigrade-150 degrees centigrade. For example, the temperature detected by the heater temperature sensor 46A is controlled to be 45 degrees centigrade.

As the heater 44A is laminated on the piezoelectric vibration plate 42A, the heat generated by the heater 44A is easily transmitted to the ink I in the pressure chamber for circulation 25*c*. Further, the temperature of the heater 44A is equal to or lower than the half of the Curie temperature of the piezoelectric vibration plate 42A so that the collapse of the piezoelectric property of the piezoelectric vibration plate 42A is suppressed. As shown in FIG. 4, the ink I in the pressure chamber for circulation 25*c* is absorbed from the flow hole 25*a* and ejected from the flow hole 25*b* in a direction indicated by an arrow A1.

The ink I ejected from the flow hole 25*b* flows into the ink supply chamber 22 through the communicating path 27 after passing the filter 30 through the ink chamber 26. The rubbish or bubble contained in the ink I is trapped by the filter 30.

If the pressure of the ink I in the ink supply chamber 22 is increased, the ink I flows into the inkjet head 16 through the ink supply pipe 52. The microcomputer 56 properly controls the actuator of the inkjet head 16 to inject the ink I from each nozzle section to carry out printing on the image receiving medium S.

The ink I that returns from the inkjet head 16 through the ink return pipe 53 without being injected from each nozzle section flows into the ink collection chamber 23. The ink I in the ink collection chamber 23 is absorbed from the flow hole 25*a* into the pressure chamber for circulation 25*c* through the inflow port 29.

In this way, through the pump for ink circulation 48, the ink I in the ink circulation device 17 and the inkjet head 16 flows to be circulated. The microcomputer 56 drives the piezoelectric vibration plate 42A to apply the voltage to the heater 44A at the time the ink I circulates in the ink circulation device 17 and the inkjet head 16. Thus, the ink I is wholly heated without being locally heated and the ink I is difficult to be destroyed. The destruction of the ink refers to alteration, degradation, separation or aggregation of the ink.

On the other hand, if the ink I in the inkjet unit 15 is reduced, the reduction of the ink I is detected by, for example, the liquid surface sensors 31A and 31B, and the detection result is sent to the unit control section 18.

The microcomputer 56 drives the piezoelectric vibration plate 42B of the pump for ink supply 49 with the pump driving circuit 57B. The ink I in the pressure chamber for supply 24*c* is absorbed from the flow hole 24*a* and ejected from the flow hole 24*b* in a direction indicated by an arrow A2.

The ink I is absorbed from the flow hole 24*a* to be supplied to the inside of the pressure chamber for supply 24*c* from the ink cartridge via the connection tube and the replenishing path 28.

On the other hand, the ink I ejected from the flow hole 24*b* flows into the ink supply chamber 22 through the communicating path 27 after passing the filter 30 through the ink chamber 26. Then, the ink I merges with the ink I indicated by the arrow A1.

In this way, through the pump for ink supply 49, the ink I is supplied from the external ink cartridge to the inside of the ink circulation device 17.

If the amount of the ink I in the inkjet unit 15 is equal to or greater than a certain amount, that the amount of the ink I is equal to or greater than a certain amount is detected by the liquid surface sensors 31A and 31B and then is sent to the unit control section 18.

The microcomputer 56 stops driving the piezoelectric vibration plate 42B of the pump for ink supply 49 with the pump driving circuit 57B.

Figure 6:
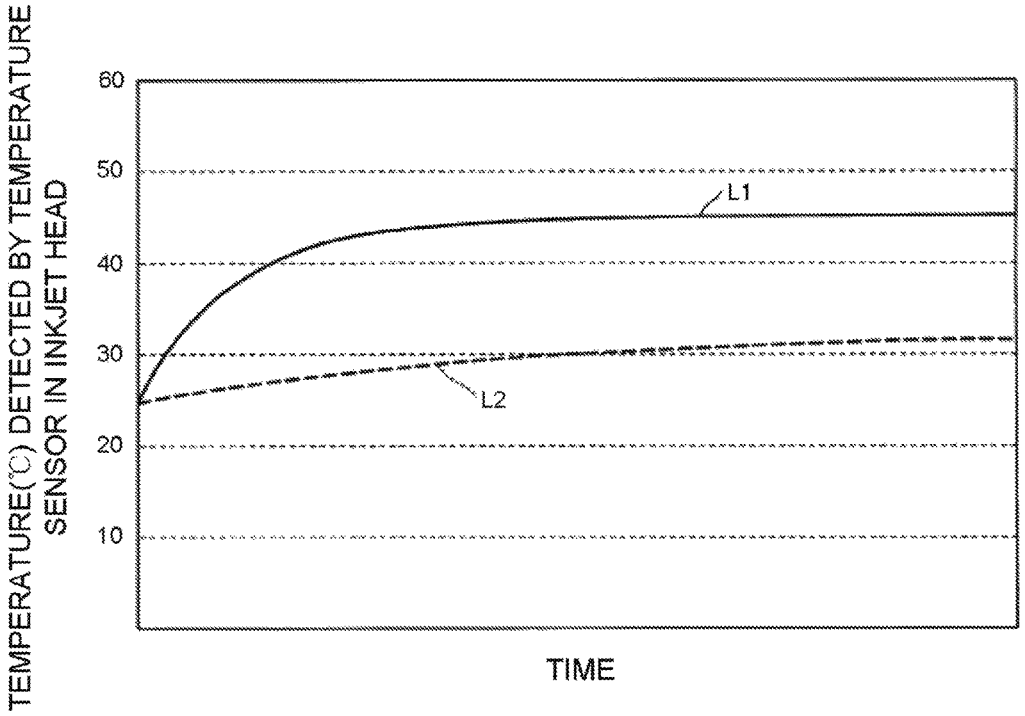
FIG. 6 is a diagram illustrating change of a temperature detected by a temperature sensor inside an inkjet head with respect to time in the ink circulation device according to an embodiment and a comparative embodiment.

FIG. 6 illustrates changes of the temperatures indicated by the vertical axis detected by the temperature sensor in the inkjet head with respect to time indicated by the horizontal axis in the inkjet units of the embodiment and the comparative embodiment. Compared with the inkjet unit of the embodiment, the inkjet unit of the comparative embodiment is not equipped with the heater temperature sensor 46A, and arranges the heater 44A on the outer surface of the lower side of the casing 21 not in the pump for ink circulation 48.

Though not shown, a thin pipe through which the ink I flows is arranged inside the inkjet head 16. A temperature sensor is arranged on the outer surface of the pipe. The heaters of the inkjet units of the embodiment and the comparative embodiment are applied with the same heat generation amount per unit time to compare the temperatures detected by the temperature sensors of the inkjet heads 16.

The experimental result of the embodiment is indicated by a curve L1 which is a solid line. The experimental result of the comparative embodiment is indicated by a curve L2 which is a dotted line. In the inkjet unit of the comparative embodiment, if the thickness of the wall of the casing 21 on which the heater is mounted is relatively large and the heat is difficult to be transmitted, as the loss due to heat dissipation is large, it can be found that the temperature detected by the temperature sensor difficultly rises as the time elapses.

On the contrary, in the inkjet unit of the embodiment, as the thickness of the actuator unit for circulation 36A on which the heater is mounted is relatively thin, the actuator unit for circulation 36A is heated at a position very close to the ink I, and the loss due to heat dissipation is small, it can be found that the temperature detected by the temperature sensor easily rises as the time elapses.

As stated above, according to the ink circulation device 17 and the printer 1 of the present embodiment, as the heater 44A is laminated on the piezoelectric vibration plate 42A, the heat generated by the heater 44A is easily transmitted to the ink I in the pressure chamber for circulation 25*c*.

When the piezoelectric vibration plate 42A is driven and the ink I flows, as the voltage is applied to the heater 44A, the ink I can be difficultly destroyed without being locally heated.

The voltage is applied to the heater 44A in such a manner that the temperature detected by the heater temperature sensor 46A is equal to or lower than the half of the Curie temperature of the piezoelectric vibration plate 42A so that the collapse of the piezoelectric property of the piezoelectric vibration plate 42A can be suppressed.

As the pump for ink circulation 48 including the heater 44A steadily feeds the ink I, the ink I can be efficiently heated by the heater 44A without destroying the ink I in the inkjet unit 15.

Further, in the present embodiment, the heater 44A may be arranged between the liquid contact sheet 41A and the piezoelectric vibration plate 42A. In other words, the heater 44A may be arranged at a position closer to the ink I which is desired to be heated by the heater 44A. Through such a configuration, the heat generated by the heater 44A is easier to be transmitted to the ink I.

The pump for ink circulation 48 is equipped with the heater 44A; however, it is not limited to that. The pump for ink supply 49 may also be equipped with a heater in addition to the pump for ink circulation 48.

In a case in which the heater 44A is coated by an insulating material, the actuator unit for circulation 36A may not include the insulating sheets 43A and 45A.

According to at least one embodiment described above, with the heater 44A laminated on the piezoelectric vibration plate 42A, the heat generated by the heater 44A can be easily transmitted to the ink I.

With respect to any figure or numerical range for a given characteristic, a figure or a parameter from one range may be combined with another figure or a parameter from a different range for the same characteristic to generate a numerical range.

Other than in the operating examples, or where otherwise indicated, all numbers, values and/or expressions referring to conditions, etc., used in the specification and claims are to be understood as modified in all instances by the term "about."

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An ink circulation device, comprising:

a pressure chamber comprising at least two flow holes through which ink flows;

a piezoelectric vibration plate constituting a part of a wall of the pressure chamber and configured to be driven to increase or decrease an inner volume of the pressure chamber;

a valve for opening and closing at least one of the two flow holes;

a heater affixed on the piezoelectric vibration plate;

a connection section connecting the pressure chamber to an inkjet head; and a temperature sensor configured to detect a temperature of the heater, wherein a voltage is applied to the heater so that the temperature detected by the temperature sensor is smaller than a Curie temperature of the piezoelectric vibration plate.

2. The ink circulation device according to claim 1, wherein when the piezoelectric vibration plate is driven and the ink flows, a voltage is applied to the heater.

3. The ink circulation device according to claim 1, further comprising a pump for ink circulation.

4. A printer, comprising:

a conveyance section configured to convey an image receiving medium printed with ink to an inkjet head; and an ink circulation device, comprising:

a pressure chamber comprising at least two flow holes through which ink flows;

a piezoelectric vibration plate constituting a part of a wall of the pressure chamber and configured to be driven to increase or decrease an inner volume of the pressure chamber;

a valve for opening and closing at least one of the two flow holes;

a heater affixed on the piezoelectric vibration plate;

a connection section connecting the pressure chamber to an inkjet head; and a temperature sensor configured to detect a temperature of the heater, wherein a voltage is applied to the heater so that the temperature detected by the temperature sensor is smaller than a Curie temperature of the piezoelectric vibration plate.

5. The printer according to claim 4, wherein when the piezoelectric vibration plate is driven and the ink flows, a voltage is applied to the heater.

6. The printer according to claim 4, further comprising a pump for ink circulation.

7. An ink circulation method within a printer, comprising:

driving a piezoelectric vibration plate constituting a part of a wall of a pressure chamber to increase or decrease an inner volume of the pressure chamber and thereby circulating ink therein;

opening and closing at least one of two flow holes in the pressure chamber;

applying voltage to a heater;

heating the piezoelectric vibration plate;

detecting a temperature of the heater; and controlling the applied voltage so that the temperature detected is smaller than a Curie temperature of the piezoelectric vibration plate.

8. The method according to claim 7, further comprising applying voltage to a heater while driving the piezoelectric vibration plate.

9. The method according to claim 7, further comprising using a pump for ink circulation.

10. The method according to claim 7, wherein the Curie temperature of the piezoelectric vibration plate is 200 to 300 degrees centigrade.

11. The method according to claim 10, wherein the temperature of the heater is one half the Curie temperature or less.

* * * * *